US006517780B1

(12) United States Patent
Cortelazzo

(10) Patent No.: US 6,517,780 B1
(45) Date of Patent: Feb. 11, 2003

(54) CONTAINER FOR LIQUIDS, PARTICULARLY FOR ANALYSIS OF BIOLOGICAL LIQUIDS

(75) Inventor: Lorenzo Cortelazzo, Padova (IT)

(73) Assignee: Kaltek S.r.l., Padova (IT)

( * ) Notice: Subject to any disclaimer, the term of this patent is extended or adjusted under 35 U.S.C. 154(b) by 0 days.

(21) Appl. No.: 09/338,492

(22) Filed: Jun. 23, 1999

(30) Foreign Application Priority Data

Jul. 2, 1998 (IT) ..... PD98A0166

(51) Int. Cl.[7] ..... B01L 3/00

(52) U.S. Cl. ..... 422/102; 422/99; 220/500; 220/507; 220/513

(58) Field of Search ..... 422/99, 100, 102, 422/939, 940, 942; 435/287, 296, 297, 298; 436/174; 215/316, 321, 901; 206/569; 220/500, 507, 513

(56) References Cited

U.S. PATENT DOCUMENTS

| | | | | |
|---|---|---|---|---|
| 4,042,337 A | | 8/1977 | Griffith | 23/259 |
| 4,073,693 A | | 2/1978 | Janin | 195/103.5 |
| 4,385,115 A | | 5/1983 | De Zabala et al. | 435/33 |
| 5,680,968 A | * | 10/1997 | Moore | 222/480 |
| 5,681,740 A | * | 10/1997 | Messier et al. | 435/284.1 |
| 5,817,510 A | * | 10/1998 | Pandey et al. | 435/305.3 |
| 5,837,139 A | * | 11/1998 | Lerch | 210/474 |
| 5,897,840 A | * | 4/1999 | Owens, Jr. et al. | 422/102 |
| 5,976,895 A | * | 11/1999 | Cipowski | 436/518 |
| 6,027,694 A | * | 2/2000 | Boulton et al. | 422/102 |
| 6,096,562 A | * | 8/2000 | Bunn et al. | 436/518 |
| 6,106,783 A | * | 8/2000 | Gamble | 422/102 |
| 6,361,746 B1 | * | 3/2002 | Wlodarski | 422/104 |
| 6,444,174 B1 | * | 9/2002 | Lascombes | 422/102 |

FOREIGN PATENT DOCUMENTS

EP 0 879 895 11/1998

* cited by examiner

*Primary Examiner*—Jill Warden
*Assistant Examiner*—Dwayne K. Handy
(74) *Attorney, Agent, or Firm*—Guido Modiano; Albert Josif; Daniel O'Byrne

(57) ABSTRACT

A container for liquids, particularly for analysis of biological liquids, comprising a main body which is constituted by a cylindrical chamber and by a plurality of cup-shaped parts for containing the liquids which protrude axially from the bottom of the chamber, an intermediate closure element which can be accommodated in the chamber and is in turn provided with tubular portions which can be inserted in the cup-shaped parts, and a sealing cover which can be coupled to the body.

13 Claims, 3 Drawing Sheets

CONTAINER FOR LIQUIDS, PARTICULARLY FOR ANALYSIS OF BIOLOGICAL LIQUIDS

BACKGROUND OF THE INVENTION

The present invention relates to a container for liquids, particularly for analysis of biological liquids.

The container is used for example for the analyses prescribed by anti-doping tests, medical examinations for enrolment in the armed forces, or in any case in a military context, for analyses prescribed for public-sector competitive examinations, industrial medicine, etcetera.

The problem of ensuring serious, accurate and reliable anti-doping tests for athletes has always been strongly felt.

Biological liquids are currently sampled after a competition by means of ordinary plastic containers which are then sealed and marked under the supervision of competition directors so as to ensure that sampling has been performed correctly.

Moreover, it is common practice to collect multiple samples in separate containers in order to allow, if necessary, to perform subsequent double-checking tests.

Regrettably, this system lends itself to easy forgery.

First of all, during the fast-paced events that follow a competition the containers might be swapped, even only due to error on the part of the assigned personnel.

Moreover, the containers may remain unattended and may be tampered with during such periods.

In addition to all this, the biological characteristics of the liquids collected in separate containers are not uniform and therefore the different samples can bias the results of the analyses.

SUMMARY OF THE INVENTION

The aim of the present invention is to eliminate the above-noted drawbacks in conventional sample containers by providing a container which simultaneously allows, in a single object, to take multiple samples and to then keep them separate.

Within the scope of this aim, an object of the invention is to provide a container which allows to analyze one sample at a time without thereby contaminating the others and/or interrupting the common seal of guarantee.

Another object of the invention is to provide a container having modest dimensions and weight which can be used easily by users.

Another object of the invention is to provide a container which is composed of a small number of simple elements which can be manufactured with known technologies, so that it can be produced at an advantageous cost.

This aim, these objects and others which will become apparent hereinafter are achieved by a container for liquids, particularly for analysis of biological liquids, characterized in that it comprises a main body which has a plurality of cup-shaped parts for containing said liquids, an intermediate closure element which can be associated with said body and is provided with tubular portions which can be inserted in said cup-shaped parts, and a sealing cover which can be coupled to said body.

BRIEF DESCRIPTION OF THE DRAWINGS

Further characteristics and advantages of the present invention will become apparent from the following detailed description of a preferred but not exclusive embodiment of the container for liquids, particularly for analyzing biological liquids, illustrated only by way of non-limitative example in the accompanying drawings, wherein.

DESCRIPTION OF THE PREFERRED EMBODIMENTS

Figure 2:
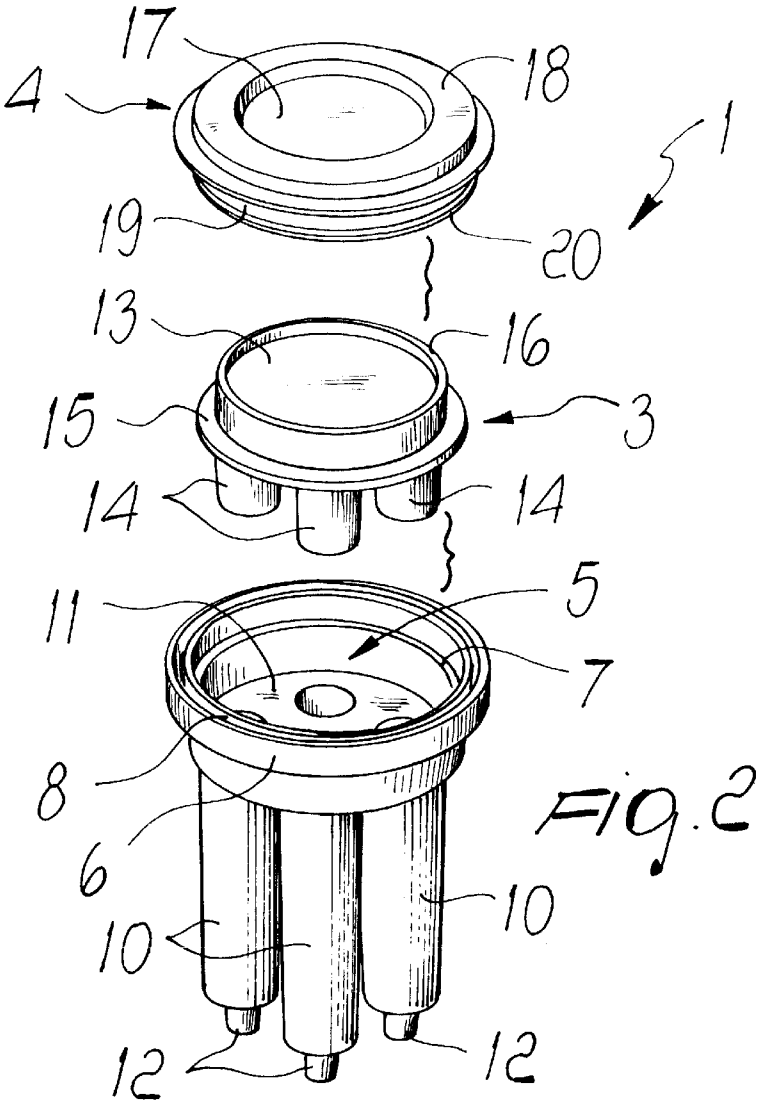
FIG. 2 is an exploded view of the container according to the invention.
Figure 1:
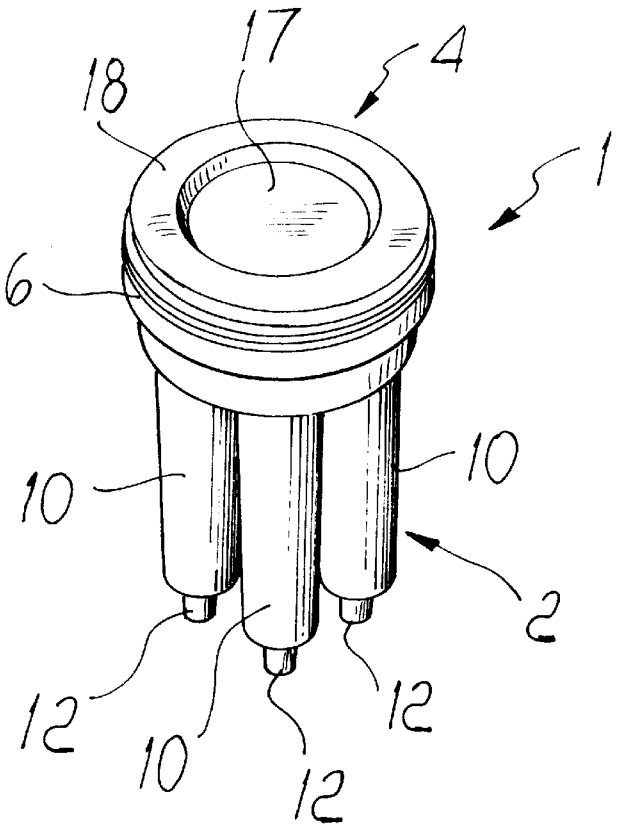
FIG. 1 is an axonometric view of the container according to the invention.
Figure 3:
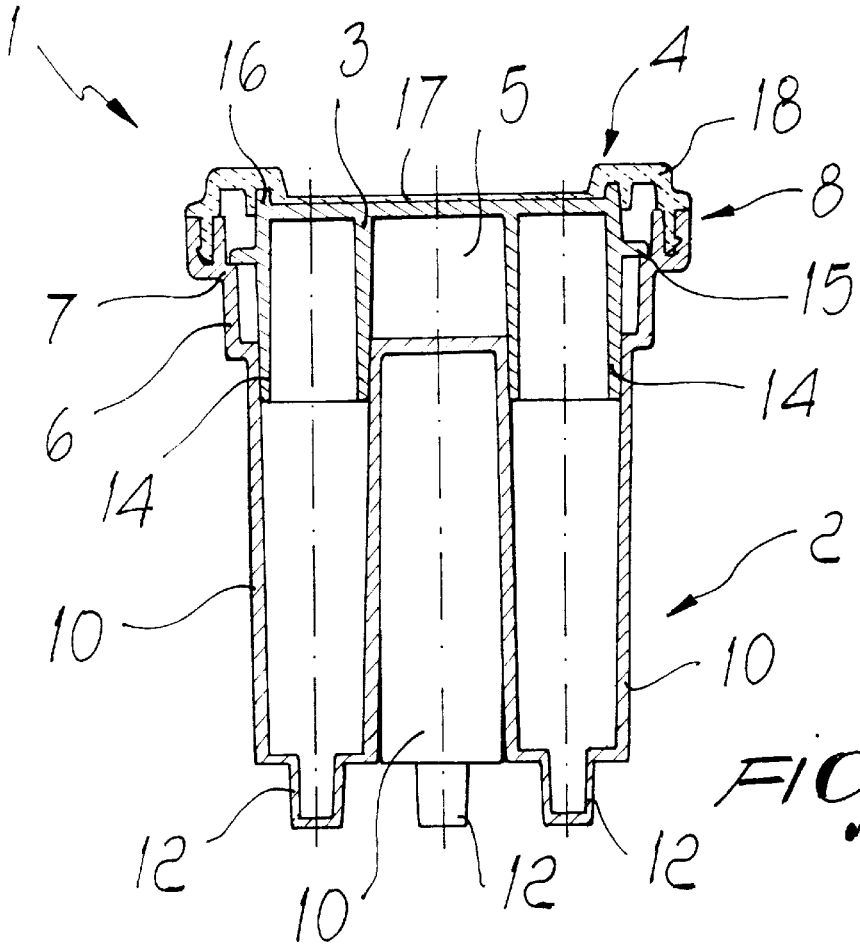
FIG. 3 is a sectional view, taken along a central plane, of the container according to the invention.
Figure 4:
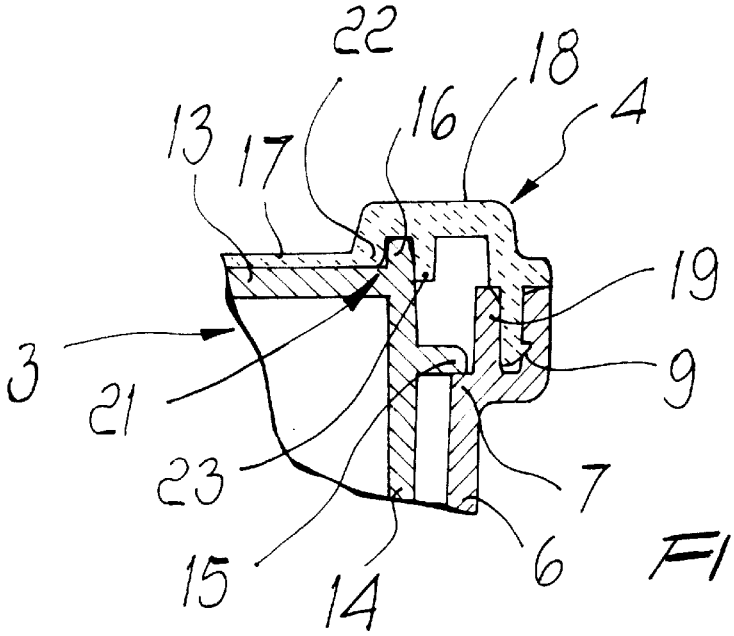
FIG. 4 is a sectional view of a detail of the container.

With reference to the above FIGS. 1 to 4, the container, generally designated by the reference numeral 1, comprises a main body 2, an intermediate closure element 3, and a sealing cover 4.

The upper portion of the main body 2 is constituted by an open-top chamber 5 which accommodates the intermediate closure element 3.

Said chamber 5 is formed laterally by a cylindrical wall 6 having, on its internal surface and halfway along its height a circumferential step 7 which acts as an abutment for the intermediate closure element 3, and has a split upper edge which forms a U-shaped circular groove 8 which has a circular recess 9 formed inside the groove along its outer edge, allowing to close the sealing cover 4 onto the main body 2 by pressing.

The lower portion of the main body 2 is composed of four cup-shaped parts 10 which are connected to the chamber 5 through the bottom 11 of said chamber and protrude from it in an axial direction, ending at their lower end with a closed narrower portion 12.

The intermediate closure element 3 comprises a circular plate 13 which has, on one face, four tubular portions 14 whose outside diameter is slightly smaller than the inside diameter of the tubular parts 10; said portions are arranged so as to fit hermetically in said parts during the coupling of the intermediate element 3 on the main body 2.

This insertion, in addition to separating the fluid in each one of the parts, produces a first mechanical conical seal.

Said circular plate 13 has, on its outer lateral surface, a flat circular ridge 15 which abuts against the step 7, accordingly preventing any improperly performed coupling of the intermediate element 3 with the main body 2.

On the face that lies opposite the tubular portions 14, the circular plate 13 has an additional circular ridge 16, which is required for centering the sealing cover 4 on said main body 2.

Said sealing cover is composed of a thin and transparent circular central portion 17 which is surrounded by a thicker border 18 provided with a circular rim 19 which lies at right angles to the border 18; said rim in turn has a circular protrusion 20 which fits with a snap-together action in the recess 9 when the rim 19 is inserted in the U-shaped groove 8.

This insertion produces a second seal which prevents the leakage of any liquid present in the central pocket and in the lateral pockets that lie between the tubular portions 14.

The sealing cover 4 further comprises, on the surface that faces the circular plate 13, a circular recess 21 which is formed by the step 22 which corresponds to the region that connects the thin central portion 17 of the cover to the border 18 and a circular ridge 23 which accommodates the ridge 16.

Conveniently, a label (not shown) bearing the identification data of the sample can be placed between the upper face of the element 3 and the lower face of the thin and transparent circular central portion 17 of the sealing cover 4.

Operation, with reference to the above figures, is as follows:

the liquid is introduced in the main body 2; a first closure is performed by coupling the intermediate body 3 to the main body 2 and then the final seal is provided by locking the cover 4 on said body 2. The tubular portions 14, in addition to closing the cup-shaped parts 10, also have the purpose of increasing the volume inside each part so as to avoid any overflow of the contained liquid during the closing operation.

During testing, any one of the narrower portions 12 is cut and its content is sampled. If double-checks are necessary following the first test, the other narrower portions 12 are cut in succession.

In practice it has been observed that the invention achieves the intended aim and objects, since said container prevents all forgery and is preset for multiple separate tests of the sampled liquid which cannot be contaminated.

Figure 5:
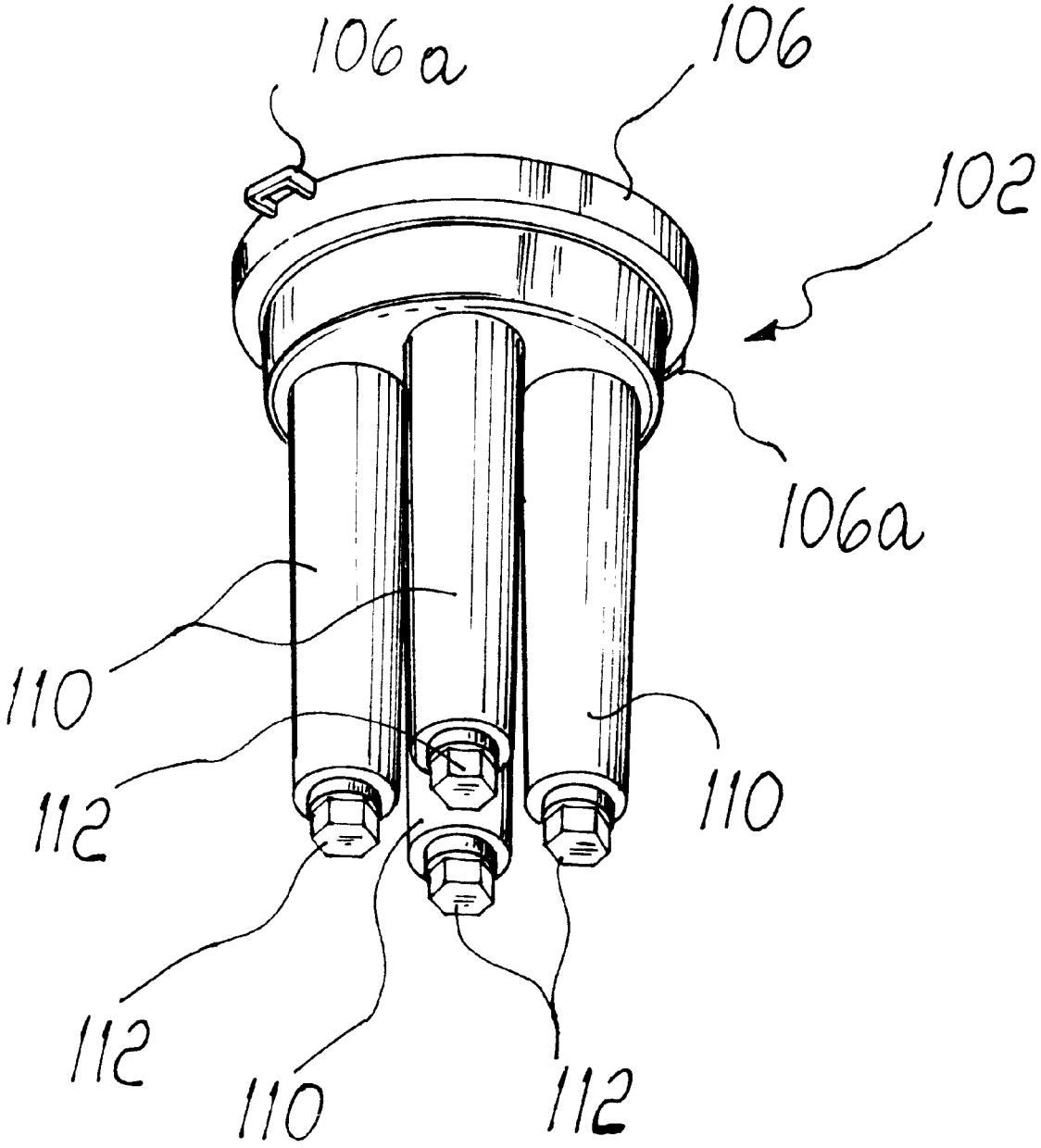
FIG. 5 is a perspective view of a further constructive embodiment of the container according to the invention.

The invention is also susceptible of numerous modifications and variations, all of which are within the scope of the inventive concept. Accordingly, with particular reference to the above cited FIG. 5, in a further constructive embodiment the container has a main body, now designated by the reference numeral 102, with a cylindrical wall 106 from which loops 106*a* protrude in diametrically opposite positions; said loops are used to fix a forgery-preventing seal, not shown.

The lower portion of the main body 102 is again composed of four cup-shaped parts 110 which protrude axially and end, at their lower end, with a closed narrower portion 112, which in this case has a hexagonal external profile to allow the mating of a hexagonal key, not shown.

Said key, by being turned, facilitates the separation of the narrower portion 112 in order to open the corresponding cup-shaped part 110.

The materials employed, as well as the contingent shapes and dimensions, may of course be any according to the requirements and the state of the art.

The disclosures in Italian Patent Application No. PD98A000166 from which this application claims priority are incorporated herein by reference.

What is claimed is:

1. A container for liquids, particularly for analysis of biological liquids, comprising a main body having an open-top chamber and a plurality of cup-shaped parts integrally connected with the open-top chamber and extending therefrom for containing said liquids, an intermediate closure element fitting in the open-top chamber and having a plurality of protruding tubular portions that fit hermetically into the cup-shaped parts; and a sealing cover configured to lock the main body.

2. The container of claim 1, wherein said open-top chamber is formed by a lateral cylindrical wall for accommodating said intermediate closure element and by a bottom portion provided with through holes, said chamber being integrally connected with said cup-shaped parts through said through holes formed in the bottom portion thereof.

3. The container of claim 2, wherein said cylindrical wall of said chamber comprises, along its internal surface, a circumferential abutment step and an upper edge which is split so as to form a circumferential U-shaped groove.

4. The container of claim 3, wherein said U-shaped groove comprises a recess formed along an inner edge thereof.

5. The container of claim 2, wherein said plurality of cup-shaped parts protrude from said bottom portion in an axial direction and end each with a respective closed narrower portion.

6. The container of claim 4, wherein said intermediate closure element comprises a circular plate which bears said tubular portions on a first side thereof and has, on an opposite second side thereof, a circular ridge for centering, upon coupling, said sealing cover, said plate having, on a lateral surface thereof, a flat circular ridge which abuts against said abutment step.

7. The container of claim 6, having a first liquid-tight seal provided by insertion of said tubular portions in said cup-shaped parts.

8. The container of claim 7, wherein said sealing cover comprises a transparent circular central portion thereof, a border which surrounds the central portion, and a circular rim which is arranged at right angles to said border for engaging said U-shaped groove.

9. The container of claim 8, wherein said sealing cover comprises a circular protrusion provided at an end of said rim which is directed toward an outside part of said cover, said circular protrusion being snap-fitted in said recess of said U-shaped groove.

10. The container of claim 9, having a second liquid-tight seal provided by snap-fitting said circular protrusion into said recess.

11. The container of claim 10, wherein said sealing cover comprises, on a surface thereof facing, upon coupling, said circular plate, a step formed at a region that connects the central portion and the border, a circular accommodation ridge for accommodating said circular centering ridge of said circular plate, and a circumferential recess formed between said step and said accommodation ridge.

12. The container of claim 3, comprising loops protruding in diametrically opposite positions of said cylindrical lateral wall of said main body for allowing fixing thereto of a seal.

13. The container of claim 5, wherein each one of said plurality of cup-shaped parts that protrude axially from said bottom portion of said main body ends, at lower end thereof, with a closed narrower portion, said closed narrower portion having an hexagonal external profile for allowing mating of a hexagonal key.

* * * * *